US008292242B2

(12) United States Patent
Thompson

(10) Patent No.: US 8,292,242 B2
(45) Date of Patent: Oct. 23, 2012

(54) TEMPORARY AFFIXING DEVICE

(76) Inventor: Danny L. Thompson, Mesa, AZ (US)

( * ) Notice: Subject to any disclaimer, the term of this patent is extended or adjusted under 35 U.S.C. 154(b) by 0 days.

(21) Appl. No.: 11/301,392

(22) Filed: Dec. 13, 2005

(65) Prior Publication Data

US 2007/0131829 A1 Jun. 14, 2007

(51) Int. Cl.
*A47G 1/17* (2006.01)

(52) U.S. Cl. ..... 248/206.5; 248/309.4

(58) Field of Classification Search ..... 248/683, 248/206.5, 309.4; 269/8; 206/818
See application file for complete search history.

(56) References Cited

U.S. PATENT DOCUMENTS 2,954,257 A * 9/1960 Besuch et al. ..... 248/206.5
4,232,420 A * 11/1980 Schuster et al. ..... 15/229.13
4,452,336 A 6/1984 Sickler
4,523,083 A * 6/1985 Hamilton ..... 219/433
5,105,963 A * 4/1992 Scott ..... 220/735
5,163,233 A 11/1992 Benson
5,259,277 A * 11/1993 Zurbuchen ..... 81/177.1
5,472,253 A * 12/1995 Resor ..... 294/65.5
5,798,001 A * 8/1998 Anderson ..... 148/120
6,029,407 A 2/2000 Schillero
6,070,718 A * 6/2000 Drabwell ..... 206/216
6,145,799 A * 11/2000 Khon ..... 248/442.2
7,108,461 B1 * 9/2006 Colburn et al. ..... 409/131
2005/0116131 A1 * 6/2005 Samuel ..... 248/357

FOREIGN PATENT DOCUMENTS

JP 09209091 A * 8/1997

* cited by examiner

*Primary Examiner* — A. Joseph Wujciak, III
(74) *Attorney, Agent, or Firm* — Gary F. Witting

(57) ABSTRACT

A temporary magnetic affixing device (100) is provided. The temporary affixing device (100) includes a base portion (102) having a first surface (114) and a second surface (112). The first surface (114) of the base portion (102) includes a magnetic device (124) attached thereto. A holding handle (138) is rotatably disposed on the base portion (102).

14 Claims, 11 Drawing Sheets

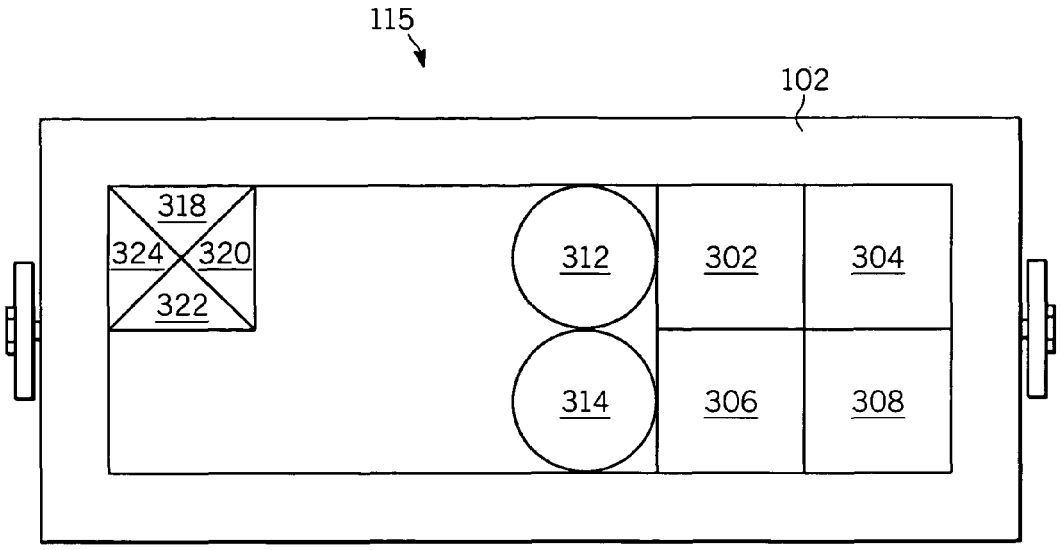
FIG. 3
FIG. 4
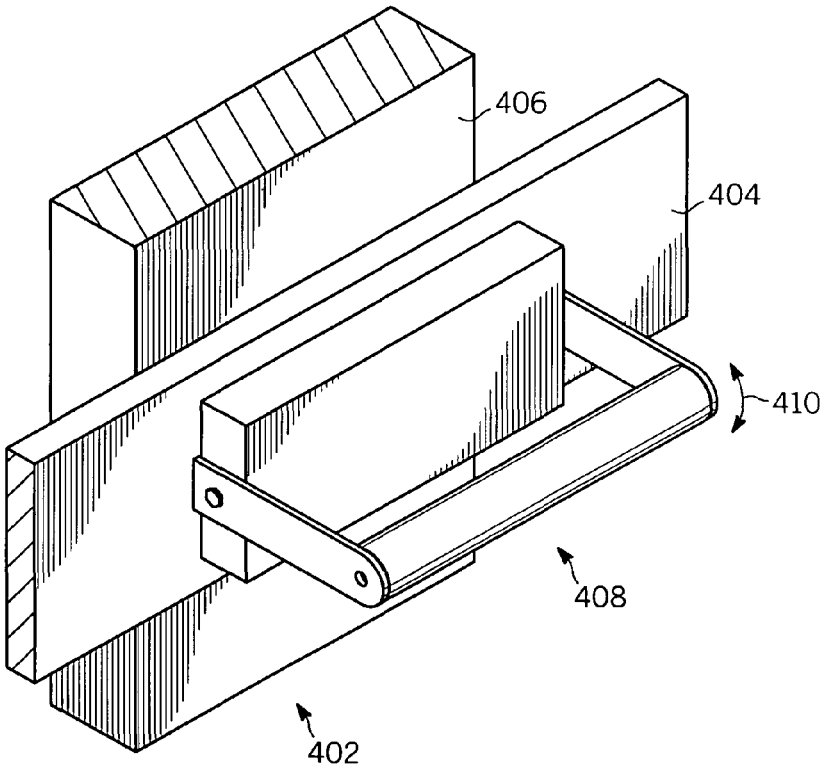

1202

TEMPORARY AFFIXING DEVICE

FIELD OF INVENTION

This invention relates in general to construction devices, and more particularly, to construction device for securing of objects during and under construction.

BACKGROUND

The use of metal fabrication elements in the construction of building, structures, and out-fitting structures has increased over the years. The use of metal studs, facings, flooring, and the like have facilitated new designs and have increased flexibility in the construction industry. However, with the use these new materials, several problems have arisen.

During construction it is sometimes important to hold metal pieces or work pieces together so that they can be joined or fastened together by some means. Currently, this is done by hand or some mechanical means which is unsatisfactory because of the time consumed and the costs associated. This problem is accentuated as the work pieces increase in size. With large work pieces, typically two or more workmen are needed to set the job up to join the work pieces together. Thus, the cost of the job is substantially increased.

Additionally, when sheet metal is used in the fabrication of ceilings, flooring, or walls, it is sometimes necessary to cut openings though the sheet metal to provide for any number of uses such as, but not limited to, windows, ports for facilities, excess ways, or the like to name a few. However, when these openings are cut the metal pieces are left to fly away unguided and unsafely. When these flying pieces of metal come in contact with another workman, sever injury or death may occur.

Conventionally, the hanging of conduits, cabling, the like in ceilings or elevated structures is a costly and inefficient process. Because of the conventional inefficiencies in the process of installing and the tooling used in same, costs are negatively impacted and the overall cost of the job is increased. Moreover, many times use of conventional methods and techniques in the hanging conduits, cabling, and the like is a two man job. Thus, for example, the use of two men doubles the efforts of a single man which further increasing the costs of the overall job.

It can be readily seen that conventional tooling and methods have several problems and disadvantages which raise serious safety concerns and produces inefficiencies that increase cost and decrease quality of the product and the process. Therefore, tools, methods, and techniques that allow for more efficient construction use that lower cost and increase safety would be highly desirable.

SUMMARY OF THE INVENTION

A temporary magnetic affixing device is provided. The temporary affixing device includes a base portion having a first surface and a second surface. The first surface of the base portion includes a magnetic device attached thereto. A holding handle is rotatably disposed on the base portion.

A temporary affixing device is provided. The temporary affixing device includes a base portion having a first surface and a second surface, a first end and a second end, and a grove disposed into the first surface. An opening is located substantially interior to the first and second sides and the first and second ends. The opening is disposed though the base portion from the first surface to the second surface. A magnetic device is positioned in the groove of the base portion. A lever arm having a first end and second end, wherein the first portion of the lever arm is rotatably disposed though the opening. A holding handle is affixed to the second portion of the lever arm.

A temporary affixing device is provided having a base portion with a first side and second side, a first end and a second end, a groove disposed in the first surface. An opening is located substantially interior to the first and second sides and the first and second ends. The opening is disposed though the first and second surfaces of the base. A magnetic device is positioned in the groove of the base portion. A first lever arm including third and four ends and a second lever arm having fifth and sixth ends. The third end of the first lever are rotatably attached to the first end of the base portion and the fifth end of the second lever arm rotatably attached to the second end of the base portion. A handle is attached between the second end of the first lever arm and the second end of the second lever arm.

A method is provided for temporarily affixing two metal pieces together. A first metal piece and a second metal piece are provided. The first metal piece and the second metal piece are positioned together. The first and second metal pieces are held together with a temporary affixing device having a base portion, a first surface, a magnetic device that is attached to the first surface, where the magnetic device clamps the first and second metal pieces together.

A work piece holding device is provided. The work piece holding device includes a frame structure having a surface, a leg having first and second ends is operably connected to the frame structure. A height adjustment device is operably connected to the frame structure with a magnetic device operably connected to the height adjustment device.

A supported work piece holding device is provided. The supported work piece holding device includes a first support structure and second support structure. The first support structure having a first leg with a first end and a second end and a second leg with a third end and a fourth end. The second support structure having a third leg with a fifth end and a sixth end and a fourth leg with seventh and eighth ends. A first and second top pieces having first and second fittings that are operably attached to the first and third ends of the first and second legs and the second top piece operably attached to the fifth and seventh ends of that third and fourth legs. A traverse support structure having a ninth end and a tenth end joined to the first fitting of the first top piece and the tenth end of the traverse support structure joined to the second fitting of the second top piece. A height adjustable device operably connected to the traverse support structure and a magnetic device operably connected to the height adjustment device.

A quick install hanging support device is provided. The hanging support device includes a base having a first surface and a second surface. An attachment device is disposed on the base with an anchoring device disposed onto the base.

A quick install hanging support system is provided. The support system includes a hanging support device having a first anchoring device and a second support structure having a second anchoring device. A cable is extended between the first and second anchoring devices.

It is an aspect of the invention to provide a device that enables a cost effective fabrication of construction elements.

It is another aspect of the invention to provide a device that enables holding of metal pieces together for fabrication.

It is another aspect of the invention to provide additional safety in working with metal construction elements.

It is another aspect of the invention to provide a means for providing a hanging support device.

It is another aspect of the invention to provide temporary affixing device.

It is another aspect of the invention to provide a hanging support system.

The foregoing general description and the following detailed description are exemplary and explanatory only and are not restrictive of the invention, as defined in the appended claims.

Additional advantages of the present invention will be set forth in the Detailed Description which follows and may be obvious from the Detailed Description or may be learned by practice of exemplary embodiments of the invention. Still other advantages of the invention may be realized by means of any of the instrumentalities, methods or combinations particularly pointed out in the claims.

BRIEF DESCRIPTION OF THE DRAWING

Representative elements, operational features, applications and/or advantages of the present invention reside inter alia in the details of construction and operation as more fully hereafter depicted, described and claimed—reference being made to the accompanying drawings forming a part hereof, wherein like numerals refer to like parts throughout. Other elements, operational features, applications and/or advantages will become apparent to skilled artisans in light of certain exemplary embodiments recited in the Detailed Description, wherein:

FIG. 3 is a greatly simplified greatly simplified plan view of a bottom surface a temporary affixing device as shown in FIGS. 1 and 2;

FIG. 4 is a greatly simplified view of a temporary affixing device holding a work piece to a metal construction element;

Figure 1:
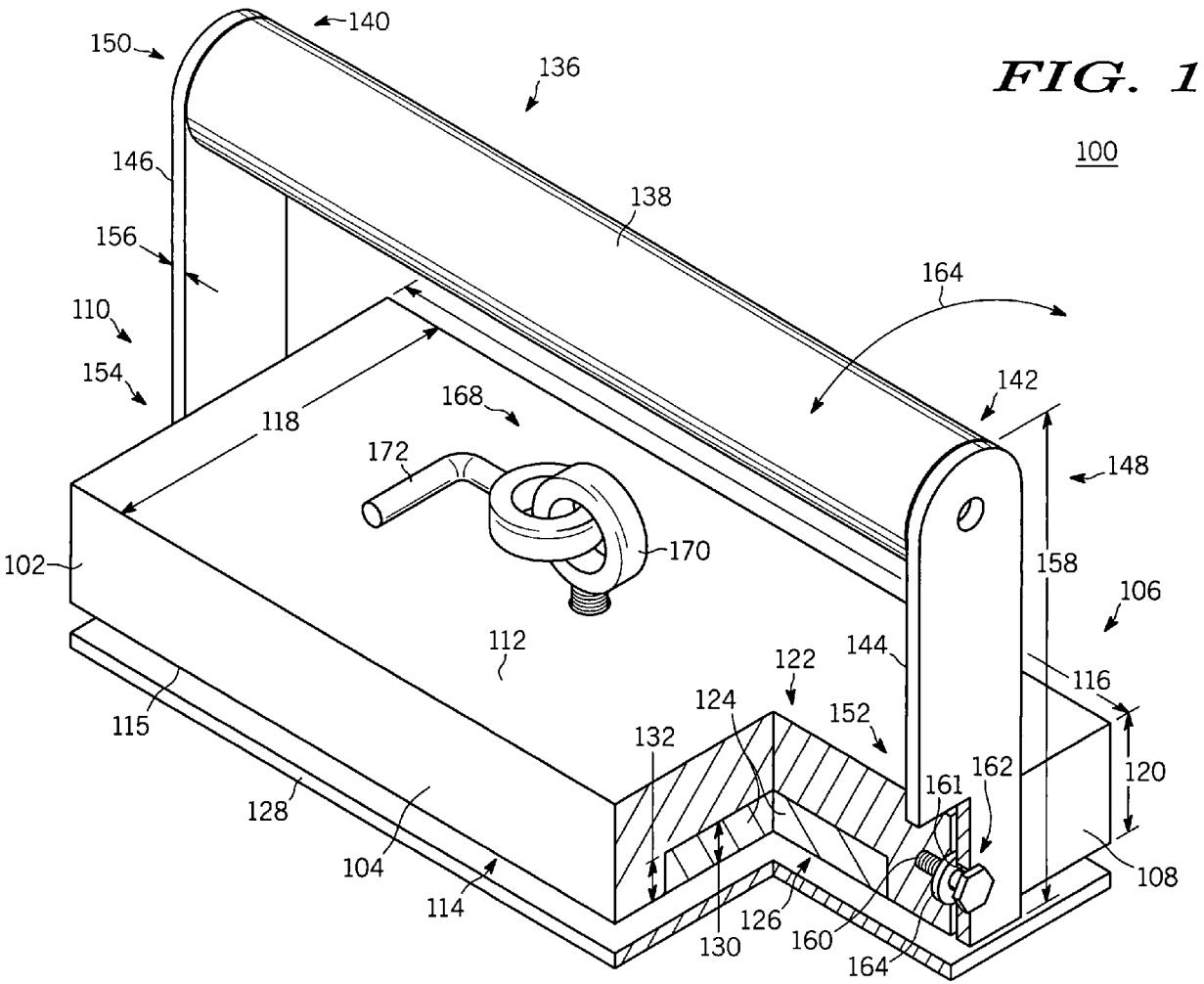
FIGS. 1 and 2 are a greatly simplified cut-away perspective view of temporary affixing devices.

Those skilled in the art will appreciate that elements in the Figures are illustrated for simplicity and clarity and have not necessarily been drawn to scale. For example, the dimensions of some of the elements in the Figures may be exaggerated relative to other elements to help improve understanding of various embodiments of the present invention. Furthermore, the terms 'first', 'second', and the like herein, if any, are used inter alia for distinguishing between similar elements and not necessarily for describing a sequential or chronological order. Moreover, the terms front, back, top, bottom, over, under, and the like in the Description and/or in the claims, if any, are generally employed for descriptive purposes and not necessarily for comprehensively describing exclusive relative position. Skilled artisans will therefore understand that any of the preceding terms so used may be interchanged under appropriate circumstances such that various embodiments of the invention described herein, for example, are capable of operation in other orientations than those explicitly illustrated or otherwise described.

DETAILED DESCRIPTION OF EXEMPLARY EMBODIMENTS

Before addressing details of embodiments described below, some terms are defined or clarified.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Also, use of the "a" or "an" are employed to describe elements and components of the invention. This is done merely for convenience and to give a general sense of the invention. This description should be read to include one or at least one and the singular also includes the plural unless it is obvious that it is meant otherwise.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Adhesive or adhesive material is intended to mean any suitable adhesive material such as, but not limited to, polymers, epoxies, polyurethanes, acrylics, silicones, polysulphides, alkyds, and hybrid polymers, resins, glues, and other materials in combination with other materials or use solely.

Magnetic device is intended to mean any suitable magnetic material or device or devices that produce magnetisium such as, but not limited to, ferrous magnets, using iron, steel, and compositions thereof, rare earth materials, e.g., aluminum nickel cobalt, samarium cobalt, neodymium, ferrite, or the like, and electromagnetic devices.

Magnetic material is intended to mean any suitable magnetic material that aids, produces, directs magnetism such as, but not limited to, ferrous material, e.g. iron, electro-magnets, rare earth materials, e.g., aluminum nickel cobalt, samarium cobalt, neodymium, ferrite, certain ceramics, or the like.

Ferrous material is intended to mean a material that has a certain amount of iron (Fe) that is part of its structure. This can also include any combination of other materials chemically or non-chemically bound.

Non-ferrous is intended to mean a material that does not have a certain amount of iron (Fe) as part of its structure.

The following descriptions are of exemplary embodiments of the invention and the inventors'conceptions of the best mode and are not intended to limit the scope, applicability or configuration of the invention in any way. Rather, the following description is intended to provide convenient illustrations for implementing various embodiments of the invention. As will become apparent, changes may be made in the function and/or arrangement of any of the elements described in the disclosed exemplary embodiments without departing from the spirit and scope of the invention.

Figure 2:
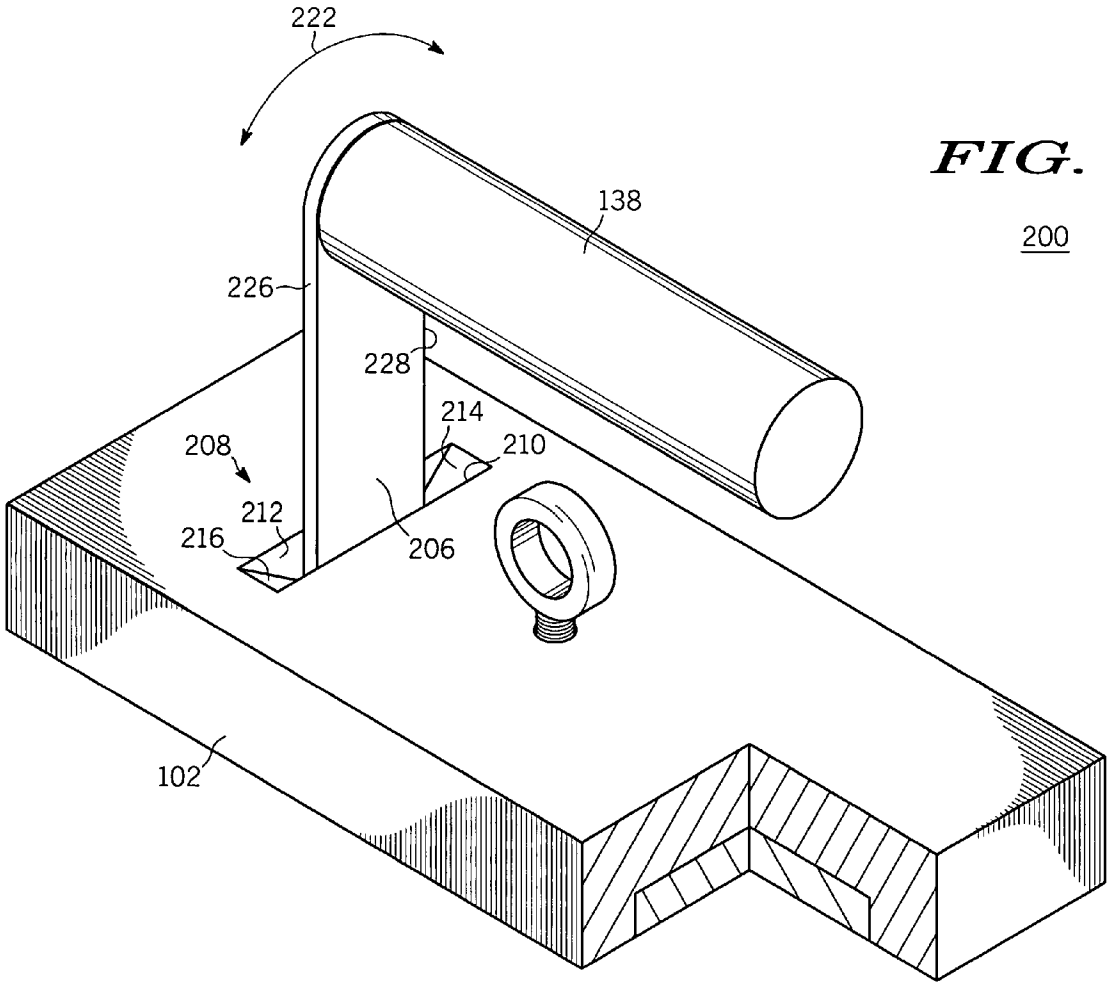

FIGS. 1 and 2 are a greatly simplified cut-away perspective illustration of temporary affixing device 100 and 200. It should be understood that similar or identical elements will retain their original identifying numbers. It should also be understood that so as to clearly illustrate the invention elements may not be drawn to scale.

Temporary affixing device 100 includes several elements such as, but not limited to, a base 102, a handle 136, and an anchoring device 170. Base 102 includes sides 104 and 106, ends 108 and 110, surfaces 112 and 114, and bottom 115. Dimensions of base 102 include a length 116, a width 118, and a thickness 120.

Base 102 can be made from any suitable magnetic or nonmagnetic material depending upon the specific application. For example, magnetic materials such as, but not limited to, cold rolled steel, hot rolled steel, cast steel, combinations thereof, or the like can be used. Alternatively, nonmagnetic material such as, but not limited to, aluminum, tungsten, some stainless steels, plastics, combinations there of, or the like can be also be used. The selection of materials used for base 102 is application specific and can encompass a wide range of materials and alloys not specifically mentioned herein above. Base 102 can be made any suitable or combination of manufacturing technologies such as, but not limited to, milling, molding, or the like. Base 102 can be configured to any suitable shape or foot print such as, but not limited to, rectangular, circular, oval, triangular, or the like. It should be understood that by changing shapes of base 102 into different shapes, base 102 will be able to fit into a wide variety of places and applications.

Base 102 can be made to any suitable dimensional size and can vary widely depending upon the specific application. For example, in some instances, length 116 can range from 2.0 centimeters to 30.0 centimeters or longer. Width 118 can be any suitable size and can vary widely depending upon the specific application. For example, in some instances, width 118 can range from 2.0 centimeters to 30.0 centimeters or longer. Thickness 120 can be made to any suitable size and can vary in accordance with the specific application. For example, in some instances, thickness 118 can range from 5.0 millimeters to 5.0 centimeters or more depending upon the specific application.

As shown in FIG. 1, a cut away portion 122 exposes magnetic device 124. Magnetic device 124 can be made of any suitable magnetic material such as, but not limited to, ferrous magnet material, e.g., iron, electromagnets, rare earth materials, e.g. aluminum nickel cobalt, samarium cobalt, neodymium, ferrite, or the like. Magnetic device 124 can be mounted in base 102 by any suitable method or technique, such as, but not limited to, adhering magnetic device 124 to a portion of base 102, or gluing magnetic device 124 to a portion of base 102, pressing the magnetic device 124 into base 102, mechanically affixing, e.g. bolting, magnetic device 124 to a portion of base 102, or the like. In this particular embodiment, a groove or recess 126 having a depth 130 is made in base 102 that allows magnetic device 124 to be inset into groove or recess 126. Both groove 126 and magnetic device 124 can be made to any suitable size depending upon the specific application. For example, groove 126 can be made deeper or shallower to accommodate stacks or magnet devices 124 or a magnetic device that is thicker. In another example, groove 126 can be made to any suitable width within the width 118 of base 102. Having magnetic devices 124 being recessed into base 102 provides several advantages, such as but not limited to, protection of magnetic devices 124 from normal wear and tear of use and possible breakage, protection of the work piece (not shown) from damage, and the like.

In yet another example, a protective shield 128 can be placed on base 102 to further shield magnetic device 124. Protective shield 128 can be made of any suitable material. It should also be understood that protective shield can be also be made by over molding base 102 so that there is a thin protective layer between magnetic device 124 and the work piece (not shown). Additionally, protective shield can be made separately and attached by any suitable method such as, but not limited to, screwing, clasping, adhesion, or the like.

In yet another example, groove 126 can be made slightly deeper then a thickness 132 of magnetic device 124, thereby providing a thin space between magnet devices 124 and the work piece (not shown).

As shown in FIG. 1, handle 136 includes a holding portion 138 with end portions 140 and 142, respectively, and arms 144 and 146 with end portions 148 and 150, respectively. Holding portion 138 can be made of any suitable material such as, but not limited to, metals or metal alloys materials, e.g., stainless steel, aluminum, and the like, as well as any suitable organic or polymeric material, e.g., plastics, polymers, resins, woods, and the like. It should be understood that combinations of any suitable materials can be used. Holding portion 138 can be made by any suitable manner or technique, such as, but not limited to, molding, milling, carving, or the like. Generally, holding portion 138 can be made to have any suitable shape, such as circular, oval, or the like. The shape of holding portion 138 should be comfortable for the hand to hold and manipulate with ease. Holding portion 138 can be made to have any suitable size. Generally, assuming holding portion 138 has a roughly circular shape, holding portion 138 can have any suitable diameter ranging from 1.0 centimeter to 5.0 centimeters.

Arms 144 and 146 are made of any suitable material such as, but not limited to, metals or metal alloys, e.g., aluminum, stainless steel, high strength plastics, or the like. Arms 144 and 146 can be made by any suitable manner or technique such as, but not limited to, milling, stamping, cutting, molding, or the like. Thickness 152 of arms 144 and 146 can be made to any suitable thickness depending upon the material set and application specifics. Generally, thickness 152 can range from 2.0 millimeters to 2.0 centimeters or more. Length 154 of arms 144 and 146 can be made to any suitable length. Generally, length 154 of arms 144 and 146 can range from 3.0 centimeters to 15.0 or more centimeters. However, it should be understood that depending upon the material set used and forces required these dimensions can vary substantially. Further, while temporary affixing device 100 is illustrated with arms 144 and 146, in some embodiments a single arm can be used.

As shown in FIG. 1, holding portion 138 extends along length 116 of base 102 and is joins arms 144 and 146. The joining of holding portion 138 to arms 144 and 146 can be achieved by any suitable method or technique such as, but not limited to, bolting, pinning, affixing, or the like. For example, when connecting end portions 150 and 152 of arms 144 and 146, a pin or roll stock can be passed thought holding portion 138 and rotatably affixed to end portions 148 and 150. Thus, the holding portion 138 is rotatably secured to end portions 148 and 150, thereby allowing holding portion 138 to rotate around pin or roll stock.

It should be understood that in some specific applications and designs holding portion 138 can be omitted and/or altered in size so as to promote flexibility in the use.

End portions 152 and 154 of arms 144 and 146 are rotatably attached to base 102 by any suitable method or technique such as, but not limited to, bolting, riveting, rotatable sleeves, or the like. For example and using cut-away port 122 to illustrate, a rotatable sleeve 161 is affixed into base 102. A bolt 160 is passed though end portion 152 though washer 164 and threaded into rotatable sleeve 160. It should be understood that in some instances washer 164 is not used to separated end portion 152 and base 102. It should be understood that in some instances a space will exist between end portion 152 and base 102 because of the rotatable sleeve or some other rotatable attachment method or technique. Rotatable attachment of arms 144 and 146 allows movement of arms 144 and 146 as shown by arrow 164. When base 102 is secured to work piece (not shown), movement of handle 136 facilitates removal of temporary affixing device 100 from the work piece (not shown) when the work is completed. It should also be understood that while arms 144 and 146 are shown approximately in central position on base 102, positioning of arms 144 and 146 can be placed anywhere on sides 104, 106, 108, and 110.

As shown in FIG. 1, a securing device system 168 is disposed on base 102. As illustrated in FIG. 1, an eyelet 170 is incorporated into base 102. However, it should be understood that any securing device system 168 can be used such as, but not limited to, a hook, an embedded bar, clip, embedding of cable 172 into base 102, or the like. With the installation of securing device system 168, other devices, such as, but not limited to, cable(s), carabineers, or the like can be attached to base 102. For example, with a cable 172 having one end attached to eyelet 170 with the other end being secured to a main support structure, if the temporary affixing device 100 would happen to break free, temporary affixing device 100 would be secured by cable 172 and not fall.

FIG. 2 illustrates a temporary affixing device 200 having a single arm 206 set into base 102 though opening 208 with holding portion 138. A portion 218 has been cut-away to more clearly illustrate the embodiment. It should be understood that many of the elements previously described in FIG. 1 are similar or the same as those used in FIG. 2. Thus a detailed description of these elements will not be necessary herein below.

Opening 208 includes sides 210 and 212 and tapered sides 214 and 216. By changing an angle 220 of tapered sides 214 and 216, the amount of rotations, indicated by arrow 222 is controlled. It should be understood that opening 208 can be cut with sides 210, 212, 214, 216 can be cut vertically. Thus, edges 226 and 228 would act as natural stops of arm 206.

Any suitable method or technique can be used to attach arm 206 to base 102 as described above. As shown in FIG. 2, a pin 224 with a bearing has been installed though arm 206 and base 102.

FIG. 3 is a greatly simplified illustration of a composite plan view of bottom 115 of FIGS. 1 and 2 showing several different configurations of magnetic device 124. It should be understood that magnetic device 124 can be stacked on top of each other. As shown in FIG. 3, magnetic devices 302-308 are rectangular in shape. It should be understood that any shape can be used such as, but not limited to, squares, circles, triangles, polygons, or the like. As described in FIG. 1, magnetic devices can be made to any suitable size. While magnetic devices 302-308 illustrate four magnetic devices, it should be understood that one or more magnetic devices could be used as well.

As shown in FIG. 3, magnetic devices 312 and 314 are circular in shape. As described in FIG. 1, magnetic device 124, and in this instance magnetic devices 312 and 314, can be made to any suitable size and shape. Thus, while magnetic devices 302-308 illustrate four magnetic devices, a single magnetic device could be used as well.

As shown in FIG. 3, magnetic devices 318-324 are triangular in shape. Magnetic devices 318-324 are triangular and have been arranged to form a rectangular shape. It should be understood that by mixing and matching various shapes of magnetic devices, that a large number of shapes can be made. Moreover, when called for, it should be understood that magnetic device 124 can be made to any desirable shape.

FIG. 4 is a greatly simplified view of a temporary affixing device 100 holding a work piece 404 to a construction element 406. Construction element 406 can be any number of kinds of construction elements, such as, but not limited to, a metal pillar, a piece of sheet metal, a metal flashing, a metal bracing, or the like. Shape of construction element 402 can be any suitable shape, providing that where work piece 404 and construction element 402 met, there is enough surface area for work piece 404, construction element, and temporary affixing device 100 can be held together. Metal work piece 404 and metal construction element are held together by magnetic forces generated by temporary affixing device 100. As shown in FIG. 4, once work piece 404 is held against construction element 406 by temporary affixing device 100, work piece 404 set in place and any suitable operation can be done to work piece 404 and construction element 406 such as, but not limited to, wielding, bolting, adhering, or the like. It should be noted that the temporary affixing of the metal work piece 404 to construction element 406 can be done by a single workman, thereby driving a greater efficiency of construction of affixing work piece 404 and metal construction element 406 with a substantially lower cost.

Once metal work piece 404 and construction element 406 have been permanently affixed, temporary affixing device 100 is removed by rotating handle 136 in either direction as indicated by arrow 164 to break the magnetic force between temporary affixing device 100 and both metal work piece 404 and metal construction element 406. Alternatively, breaking of the magnetic force between temporary affixing device 100, metal work piece 404, and metal construction element 406 allows for further adjustment of temporary affixing device 100, metal work piece 404, and metal construction element 406.

Figure 5:
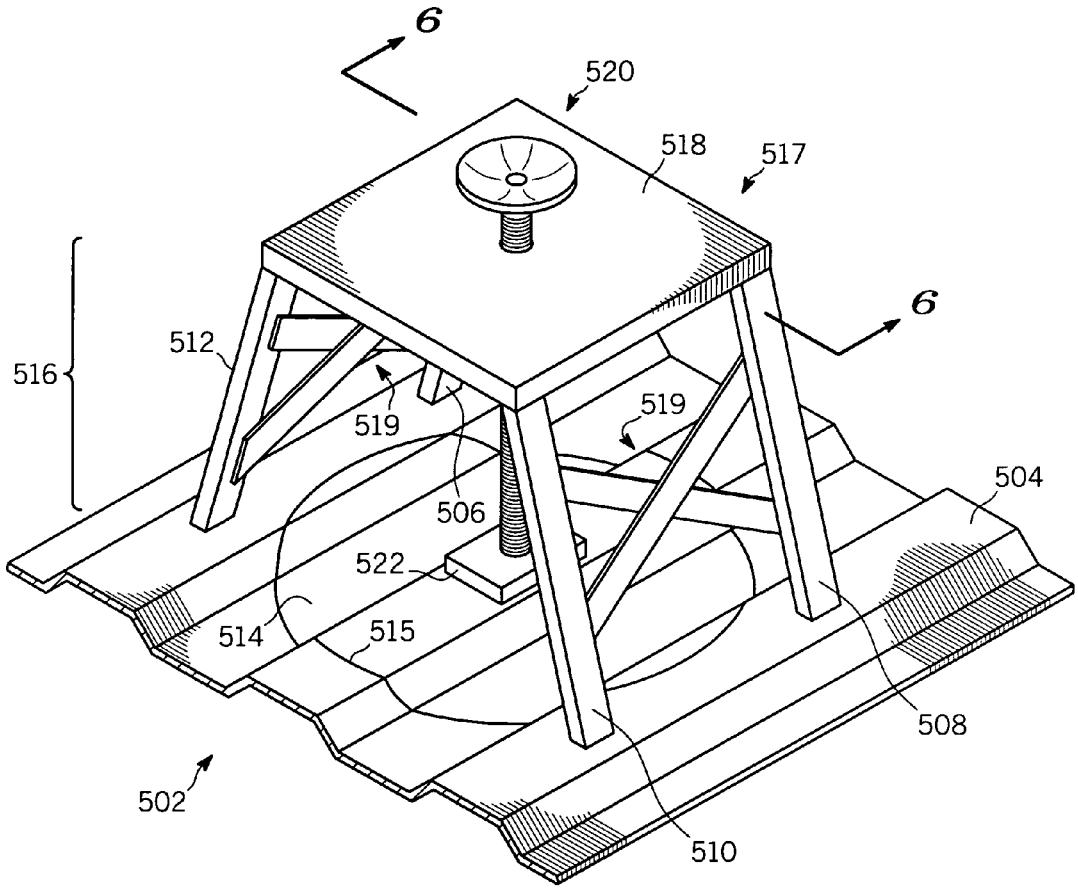
FIG. 5 is a greatly simplified perspective view of a work piece holding device.
Figure 6:
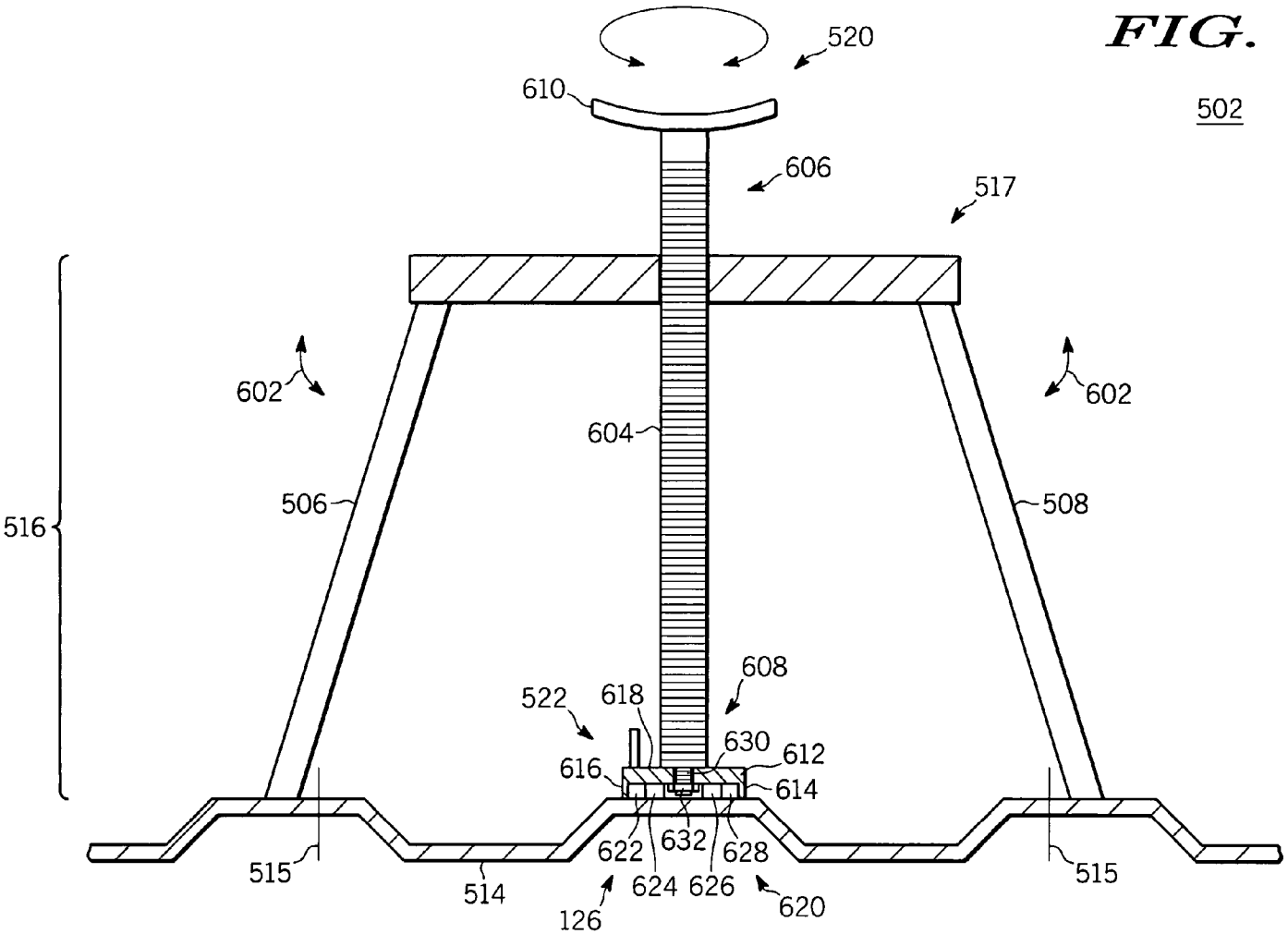
FIG. 6 is a greatly simplified sectional view taken though 5-5 of FIG. 5 of a work piece holding device.

Referring now to FIGS. 5 and 6, FIG. 5 is a greatly simplified perspective illustrative view of a work piece holding device 502 positioned on a metal sheet 504 and FIG. 6 is a greatly simplified sectional illustrative view taken though 6-6 of FIG. 5 of a work piece holding device 502. Generally, as shown in FIG. 5, work piece holding device 502 provides a means for holding work piece 514 of metal sheet 504. Work piece holding device 502 is made of several elements such as, but not limited to, a frame 516 with a platform 517 having a surface 518, legs 506-512, and braces 519, height adjustment device 520, and a magnetic holding device 521.

Generally, frame 516 supports height adjustment device 520 which allows height adjustment device 520 to raise and lower magnetic holding device 521 into position. In this embodiment, frame 516 supports platform 517 having surface 518. Legs 506-512 are connected to platform 517 by any suitable method or technique such as, but not limited to, pinning, bolting, or the like. Typically, legs 506-512 are capable of swinging and locking, indicated by arrows 602. By having legs 505-512 being able to swing, a more stable and robust work piece holding device can be used. Also, legs 506-512 can be made adjustable, thereby allowing a further degree of adjustment to work piece holding device 502. Braces 519 can be used to secure legs 506-512 and lock legs 506-512 in place. Typically, frame 516 can be made of any suitable material such as, but not limited to, metal, e.g., aluminum, chrome molly, steel, any suitable plastic material, carbon fiber, composites thereof, and the like.

Height adjustment device 520 can be made by any suitable mechanism or technique that allows magnetic holding device 521 to be elevated or lowered to operating position. In this embodiment, height adjustment device 520 includes a shaft 604 having ends 606 and 608. Shaft 604 passes thought platform 517 with end 606 operably attached to a handle 610 and to magnetic holding device 521. Shaft 604 has screw threads which are engaged in platform 517, thereby allowing magnetic holding device 521 to be raised and lowered into position by turning handle 610. However, it should be understood that other methods could be use to adjust the height or location of magnetic holding device 521, such as, but not limited to, a chain driven adjustment system, a binding shaft system, an electromechanically driven device, or the like.

Magnetic holding device 521 includes several elements such as, but not limited to, a base 612 having sides 614 and 616, surfaces 618 and 620 (other sides not shown), magnetic devices 622-628, and connection 630. Base 612 can be made from any suitable nonmagnetic material such as, but not limited to, aluminum, tungsten, stainless steel, plastics, combinations there of, or the like. The selection of materials used for base 102 is application specific and can encompass a wide range of materials and alloys not specifically mentioned herein above. Base 612 can be made any one of a number of different manufacturing technologies such as, but not limited to, milling, molding, or the like.

Base 612 can be configured to any suitable shape or foot print such as, but not limited to, rectangular, circular, oval, triangular, or the like. It should be understood that by changing shapes of base 612 into different shapes, base 612 will be able to fit into a wide variety of places and applications.

Base 612 can be made to any suitable dimensional size and can vary widely depending upon the specific application. For example, in some instances, length can range from 5.0 centimeters to 50.0 centimeters. Width can be any suitable size and can vary widely depending upon the specific application. For example, in some instances, the width can range from 5.0 centimeters to 55.0 centimeters or more. Thickness 120 can be made to any suitable size and can vary in accordance with the specific application. For example, in some instances, thickness of base 612 can range from 5.0 millimeters to 5.0 centimeters, or more depending upon the specific application.

As shown in FIG. 6, base 612 is sectioned exposing magnetic devices 622-628. Magnetic devices 622-628 can be made of any suitable magnetic material such as, but not limited to, ferrous magnets, electro-magnets, rare earth metals, or the like. Magnetic devices 622-628 can be mounted in base 612 by any suitable method or technique, such as, but not limited to, adhering magnetic devices 622-628 to a portion of base 612, or gluing magnetic devices 622-628 to a portion of base 612, pressing the magnetic devices 622-628 into base 612, mechanically affixing, e.g. bolting, magnetic devices 622-628 to a portion of base 612, or the like. In this particular embodiment, a groove or recess having a depth is made in base 612 that allows magnetic devices 622-628 to be inset into the groove or recess. Both groove and magnetic devices 622-628 can be made to any suitable size depending upon the specific application. For example, the groove can be made deeper or shallower to accommodate stacks of magnet devices 622-628 or a magnetic device that is thicker. In another example, groove 126 can be made to any suitable width within the width of base 612. Having magnetic devices 622-628 being recessed into base 612 provides several advantages, such as but not limited to, protection of magnetic devices 124 from normal wear and tear of use and possible breakage, protection of the work piece (not shown) from damage, and the like.

In yet another example, a protective shield (not shown in FIG. 6) can be placed on base 612 to further shield magnetic devices 622-628 from harm and possible breakage. The protective shield (not shown in FIG. 6) can be made of any suitable material similar to the materials used in making base 612. It should also be understood that protective device can be also be made by over molding base 612 so that there is a thin protective layer between magnetic device 124 and the work piece (not shown).

Base 612 is operationally connected to end 608 of shaft 604 by any suitable method or technique such as, but not limited to, bolting, welding, fixedly detachable, rotatably, swiveling affixing techniques, or the like. For example, as shown in FIG. 6, shaft 630 could be press fitted or welded into base 612. In yet another example, shaft 630 can be fully or partially threaded so as to allow nut 632 to more fully secure base 612 to shaft 604. In yet another example, a swiveling attachment can be attached to base 612 and end 608 of shaft 604, thereby allowing base to move and be adjusted to metal sheet 514.

As shown in FIGS. 5 and 6, sheet metal 504 could be part of any construction element such as, but not limited to, a roof, a ceiling, a floor with a substructure underneath, an elevated floor, or the like and work piece could be a port or opening for any number of things such as, but not limited to, air ducts, cabling ducts, or the like that needs to be cut away or removed, indicated by a line 515. Placing work piece holding device 502 over work piece 514 with magnetic holding device 522 operably engaged with work piece 514 relatively secures work piece 514 in place, thereby allowing work piece 514 to cut away from metal sheet safely. Since work piece 514 is secured after the cutting operation is done, work piece 514 can be safely removed. Moreover, by having work piece 514 secured by work piece holding device 502, a single workman can do the cutting operation safely.

Figure 7:
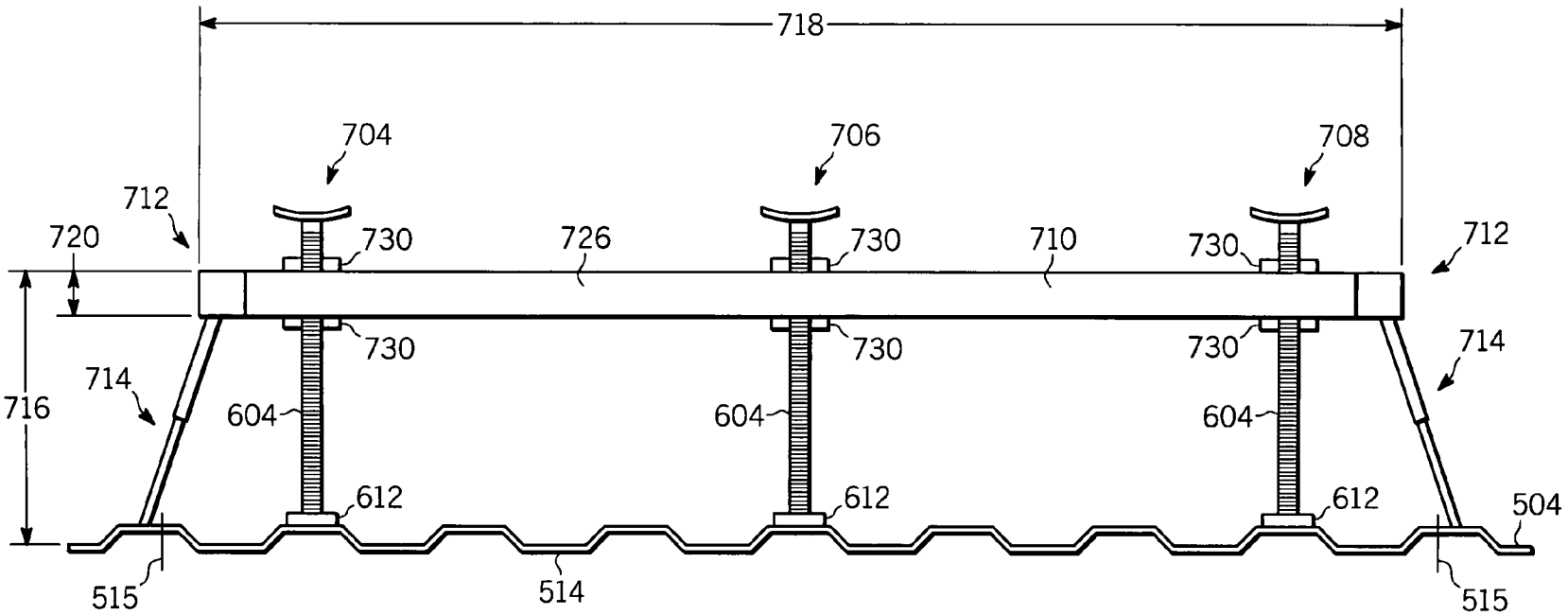
FIG. 7 is a greatly simplified illustrative side view of an extended work piece holding device having a plurality of work piece holding devices.

FIG. 7 is a greatly simplified illustrative side view of an extended work piece holding device 702 having a plurality of work piece holding devices 704-708 positioned across an extension bar 710. Generally, extended work piece holding device 708 includes extension bar 710, beam supports 712 with legs 714, and the plurality of work piece holding devices 704-708, and clamps 732-736. Beam supports 714 include legs 714 and are made so that legs 714 support and elevated extension beam 710 above work piece 514 of sheet metal 504. Typically, legs 714 are attached to extension beam 710 by any suitable means such as but not limited to, bolting, special attachments, or the like. Height of legs 714 may also be adjusted to any desired height. Thus, beam 710 can be set to any suitable distance 716 from metal sheet 504 to extendable beam 710.

Extendable beam 710 can be any suitable length 718, height 720, and width (not shown). Generally, suitable length 716 can range from 0.5 meters to 1.0 meters, 1.0 meters to 2.0 meters, and 2.0 meters to 5.0 meters; suitable height 720 and widths can range from 2.0 centimeters to 5.0 centimeter, from 5.0 centimeters to 10.0 centimeters or more. Extendable beam 710 can be made to any suitable shape such as, but not limited to, a square, rectangle, I-shaped, and a rectangle with an opening(s) cut though, or the like. It should be understood that while the shape of beam 710 can be arbitrary selected in some embodiments, but in other embodiments the shape can have provide certain attributes such as, but not limited to, strength, weight reduction, capability of positioning work piece holding devices 704-706, and the like.

Work piece holding devices 704, 706, and 708 are disposed along extension beam 710. Work piece holding devices 704, 706, and 708 have been generally described in FIGS. 5 and 6 shall not be described in detail here. However, for the sake of clarity, work piece holding devices 704, 706, and 708 include height adjustment device 520 which can use any suitable method or technique previously discussed to adjust height of base 612. As shown in FIG. 7 shaft 604 can be lengthened or shortened to operably place base 612 in position with work piece 512.

Work piece holding devices 704, 706, and 708 are disposed along extension beam 710. For example, with a groove 726 cut though extension beam 710, opposing collars 730 having a threaded opening for shaft 604 to pass are clamped against extension beam 710. The opposing collars 730 provide quick release and easily adjustable manner to move work piece holding devices 704, 706, and 708 along extension beam 710. Alternatively, work piece holding devices 704, 706, and 708 can be secured and detachably affixed along the sides of extension beam 710.

Figure 8:
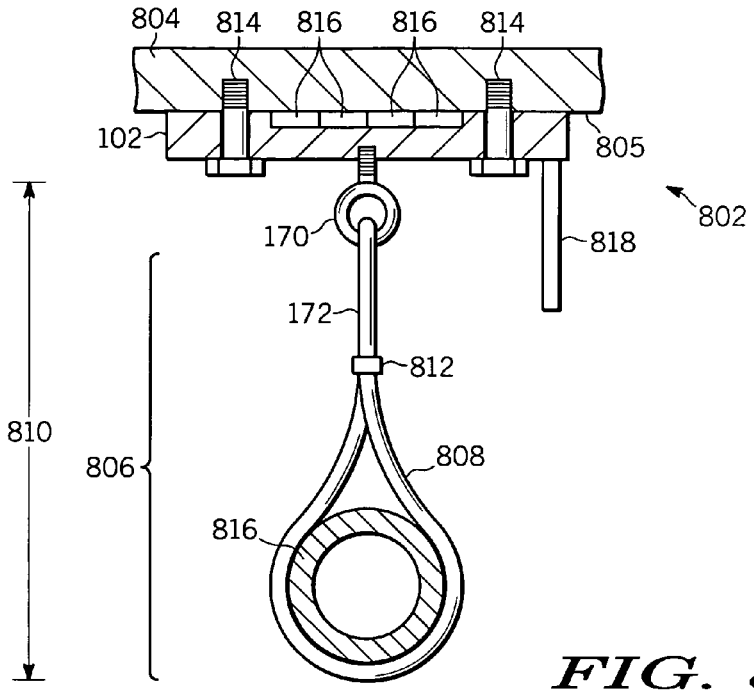
FIG. 8 is a greatly simplified sectional view of a hanging support device.

FIG. 8 is a greatly simplified sectional illustrative view of a hanging support device 802 affixed to substrate 804 though surface 805. While substrate 804 is shown in a horizontal position, it should be understood that substrate 804 can be in any suitable orientation. Several elements have been described previously and will be further described as necessary for clarity.

Substrate 804 can be made of any number of materials or composites such as, but not limited to metal, concrete, drywall, or the like. Hence, some of the materials making up substrate 804 will be non-magnetic and some materials will be magnetic. Thus, the affixing of hanging support device 802 to substrate 804 can be achieved by several different or in combination of several methods or techniques. Generally, hanging support device 802 includes base 806, anchor 170; and support loop 806.

As shown in FIG. 8, support loop 806 includes cable 172, a loop 808, a length 810, and adjustable affixing device 812. Cable 172 has been described previously and need not be described in detail here. However, as shown in FIG. 8, cable 172 is attached to anchor 170 with one end while the other end has been formed into loop 808 and is secured by adjustable affixing device 812. Formation of loop 808 by adjustable affixing device 812 can be done by any suitable method or technique such as, but not limited to, bolting, crimping, tying, weaving, molding, or the like. Loop 808 can be adjusted to any suitable size to support load 816. Load 816 can be any suitable load such as, but not limited to, conduit, cables, wire, and the like. However, it should be understood that loop 808 can be used with or without load 816. It should also be understood that in some circumstances, a pre-manufacture support loop 806 having various sized loops and lengths can be used. These pre-manufactured support loops can be easily secured to base 102 by any suitable method or technique such as, but not limited to, bolting, carabeaning, or the like. Additionally, it should be understood that hanging support device 802 can be made with support loops 806 with various lengths 810 and loop 808 of various sizes.

As shown in FIG. 8, base 102 can either be permanently affixed, temporarily affixed, or semi-permanently affixed to substrate 804. In the case of permanently affixing base 102 to substrate 804, securing devices 814 such as, but not limited to, bolting, e.g., winged bolts, gun bolts, slot bolts, or the like can be used. Also, permanent or a semi-permanent affixing of base 102 to substrate 804 can be achieved by any number of adhesives such as epoxies, resins, or the like. It should be understood that in some cases adhesives can be used to permanently affix base 102 to substrate 804. For example only, bolts 814 are driven into substrate 804 to affix base 102 to surface 805. In the case of temporarily affixing base 102 to substrate 804, with substrate 804 being made of metal or a magnetic material, or a portion thereof, magnetic devices 816 provides magnetic coupling used to temporarily support hanging support device 802. A handle 818 may be supplied to leverage and break the magnetic force between surface 804 and magnetic device 124 as described previously. In another example, base 102 can be adhered to surface 805 by any suitable adhesive such as, but not limited to, resin or glue polymers, epoxies, polyurethanes, acrylics, silicones, polysulphides, alkyds, and hybrid polymers. It should be understood that any suitable method or technique can be used for application of the resin or glue. It should be further understood that any of the above methods and techniques can be use either separately or together in any combination.

Figure 9:
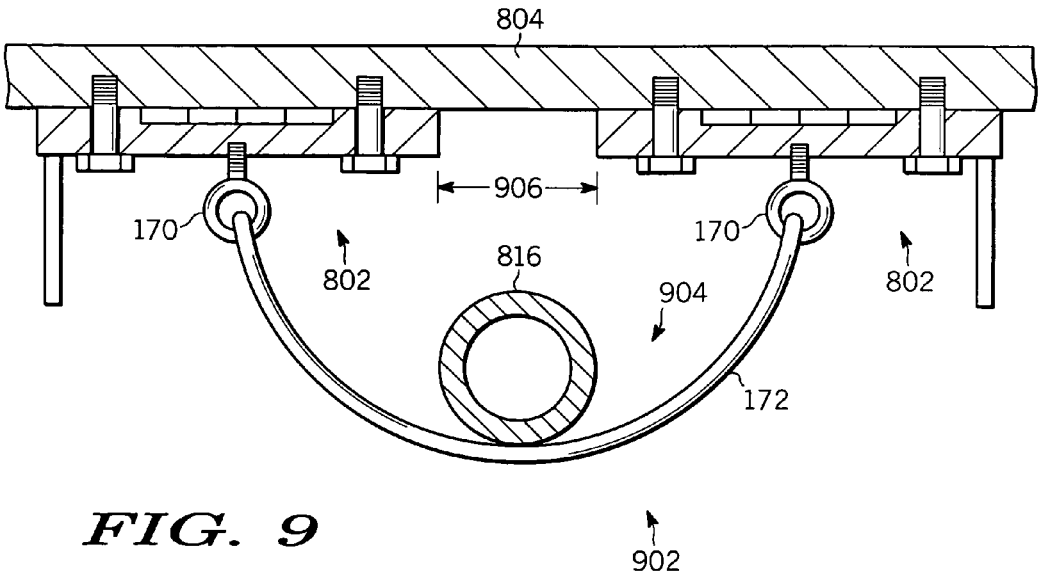
FIG. 9 is a greatly simplified sectional view of a truss hanging support system.

FIG. 9 is a greatly simplified sectional illustrational view of a hanging support system 902. Hanging support system 902 includes two or more hanging support devices 802. Hanging support devices 802 have been described in FIG. 8 and will not be re-described here. As can be seen in FIG. 9, one end of cables 172 are attached to anchors 170, as described hereinabove, while the other ends of cables 172 are connected or affixed together to form a sling 904 to hold load 816. The affixing or connecting of cables 172 can be achieved by any suitable method or technique, such as, but not limited to adjustable clamps which bind cables 172 together, splicing, tying, or the like. It should be understood also that cables 172 could also be one solid cable that is attached to anchors 170 to provide the sling to hold load 816. It should be understood that a distance 906 can be any suitable distance.

Figure 10:
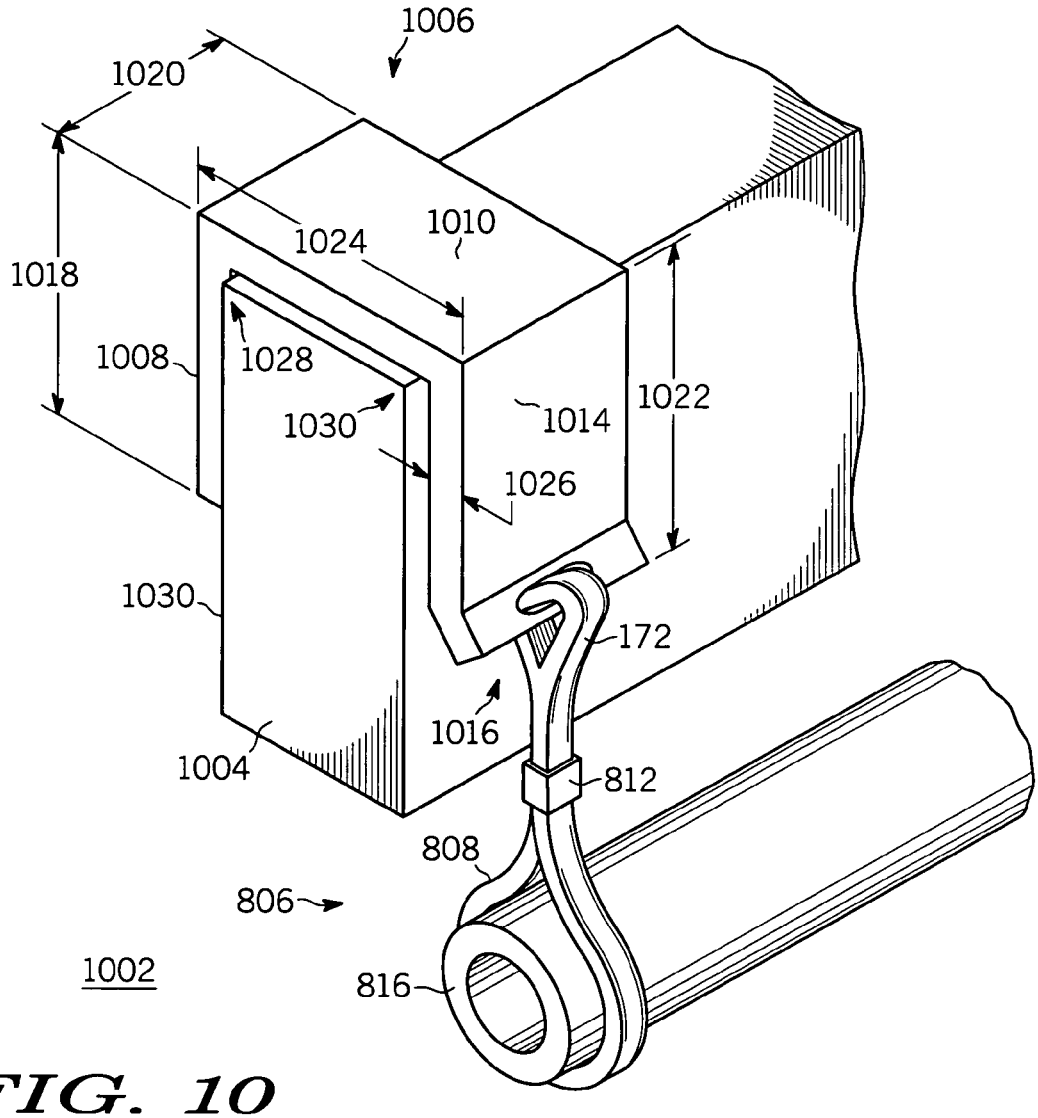
FIG. 10 is a greatly simplified illustration of a side perspective view of a truss hanging support device.

FIG. 10 is a greatly simplified side view of a truss hanging support device 1002 installed on a truss 1004. Several elements have been described previously and will not be described further here except to bring further clarity.

Truss 1004 can be made of any number of materials or composites such as, but not limited to metal, wood, plastic, or the like. Additionally, truss 1004 can be shaped into any suitable geometric shape such as, but not limited to, rectangular, circular, oval, U-shaped, square, or the like. However, it should be understood that care needs to be taken so that a sufficient amount of purchase can be obtained to support truss hanging support device 1002. Moreover, the geometric shapes can be hollowed, filled, or the like depending upon the specific application.

Generally, truss hanging support device includes hook 1006 having sides 1010, 1012, and 1014, anchor 170, cable 172, loop 808, and adjustable affixing device 812. Hook 1006 can be made of any suitable material such as, but not limited to, metals, e.g., aluminum, steel, and alloys, plastics, or the like. It should be understood that selection of material used for hook 1006 is application specific and that the selection of materials will vary in strength and in weight. By selecting the proper material for hook 1006 a correct balance can be achieved between weight and strength to support load 816.

As shown in FIG. 10, hook 1006 has sides 1008, 1010, and 1014 with side 1014 terminating in anchor 1016. Sides 1008, 1010, and 1014 having length 1018, width 1020, and length 1022, respectively, when taken as a whole partially enclose or surround truss 1004 such that hook 1006 is detachably affixed to truss 1004. Lengths 1018, 1022, 1024, width 1020, and thickness 1026 can be made to any suitable dimension depending upon the specific application. Generally, length 1018 of side 1008 and length 1022 of side 1014 can be made to range from just over corners 1028 and 1030, respectively, of truss 1004 to any suitable length. However, it should be understood that by making length 1018 of side 1008 to just extend over corner 1028 can cause stress on corner 1028 and erode its holding capability depending upon load 816. However, by extending side 1008 down a side 1030 of truss 1004, the stress is spread along side 1030 of truss 1004. It should be understood that length 1018 of side 1008 and length 1022 or side 1014 can extend below truss 1004. Also, it should be understood that side 1008 can be terminated in any suitable shape such as, but not limited to, a flare with and opening, an attachment device such as, but not limited to a bolt, a nut, or the like.

Length 1024 can be any suitable length depending upon the specific application. For example, with hook 1006 being disposed over corners 1028 and 1030 of if truss 1004 and with truss 1004 being a finished 2×6 (Smooth on all Four Sides, S4S), length 1024 will approximate the size of a finished 2×6 truss 1004. In yet another example, with hook 1006 being disposed over corners 1028 and 1030 or truss 1004 and truss 1004 is 6×6, length 1024 will approximate the size of a 6×6 truss 1004. Hence, it should be understood that dimensions of hooks 1006 can change depending upon the specific size of the truss.

Side 1014 terminates with anchor device 1016. Anchor device 1016 can be made by any suitable method or technique such as, but not limited to, having an opening in side 1014, having a bar attached to provide and opening, or the like. As shown in FIG. 10, side 1014 with anchor 1016 can be flared outwardly so that attachment of cable 172 can be achieve without the possible interference of securing hook 1006 to truss 1004. Additionally, by extending side 1014 below truss 1004 side 1014 may terminate with anchor 1016.

Loop 806 includes cable 172, a loop 808, and adjustable affixing device 812. Cable 172 has been described previously and will not be described in detail here. However, as shown in FIG. 10, cable 172 is attached to anchor 1016 with one end while the other end has been formed into loop 808 and is secured by adjustable affixing device 812. Formation of loop 808 by adjustable affixing device 812 can be done by any suitable method or technique such as, but not limited to, bolting, crimping, tying, weaving, or the like. Loop 808 can be adjusted to any suitable size to support load 816. However, it should be understood that loop 808 can be used with or without load 816. It should also be understood that in some circumstances, a pre-manufacture support loop 806 having various sized loops and lengths can be used. These pre-manufactured support loops can be easily secured to anchor 1016 by any suitable method or technique such as, but not limited to, bolting, carabineer, tying, weaving, or the like. Additionally, it should be understood that hanging support device 802 can be made with support loops 806 with various lengths 810 and loop 808 of various sizes.

Figure 11:
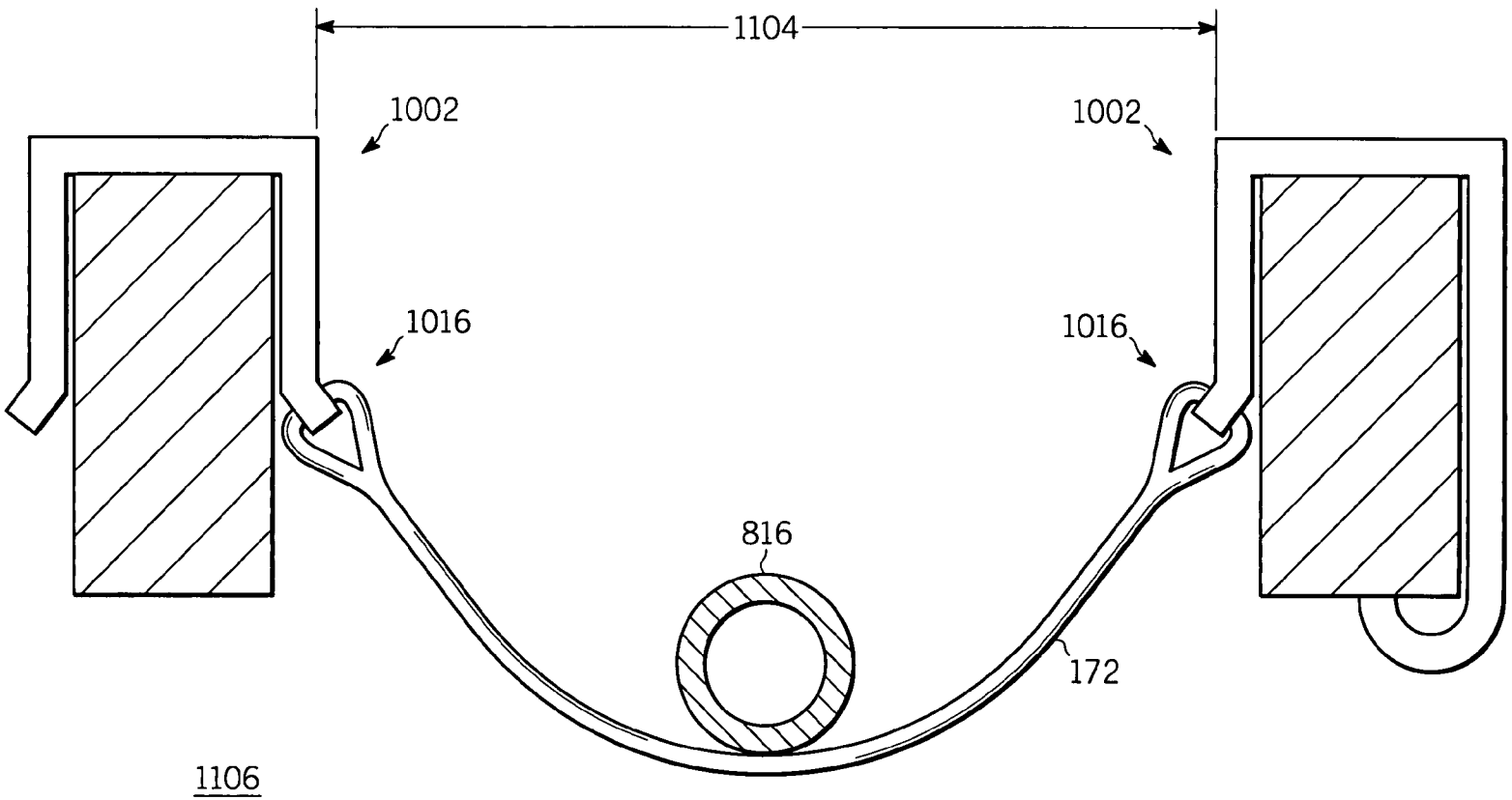
FIG. 11 is a greatly simplified side view of a truss hanging support system.

FIG. 11 is a greatly simplified sectional illustrational view of a truss hanging support system 1102. Truss hanging support system 1100 includes two or more truss hanging support devices 1002. Truss hanging support devices 1002 have been described in FIG. 10 and will not be described here except to bring more clarity. As shown in FIG. 11, truss hanging support devices 1002 can be modified so that sides can have an additional shapes and openings such as but not limited to an additional flare that can have an anchor point or a side that extends and curve around a truss. As can be seen in FIG. 11, one end of cables 172 are attached to anchors 1016, as described hereinabove, while the other ends of cables 172 are connected or affixed together to form a sling to hold load 816. The affixing or connecting of cables 172 can be done by any suitable method or technique, such as, but not limited to adjustable clamps which bind cables 172 together, splicing, tying, or the like. It should be understood also that cables 172 could also be one solid cable that is attached to anchors 170 to provide the sling 1106 to hold load 816. It should be understood that a distance 1104 can be any suitable distance. Additionally, while FIG. 11 show truss hanging support system 1002 being hung between two trusses, truss hanging support system can also be hung on the same truss.

Figure 12:
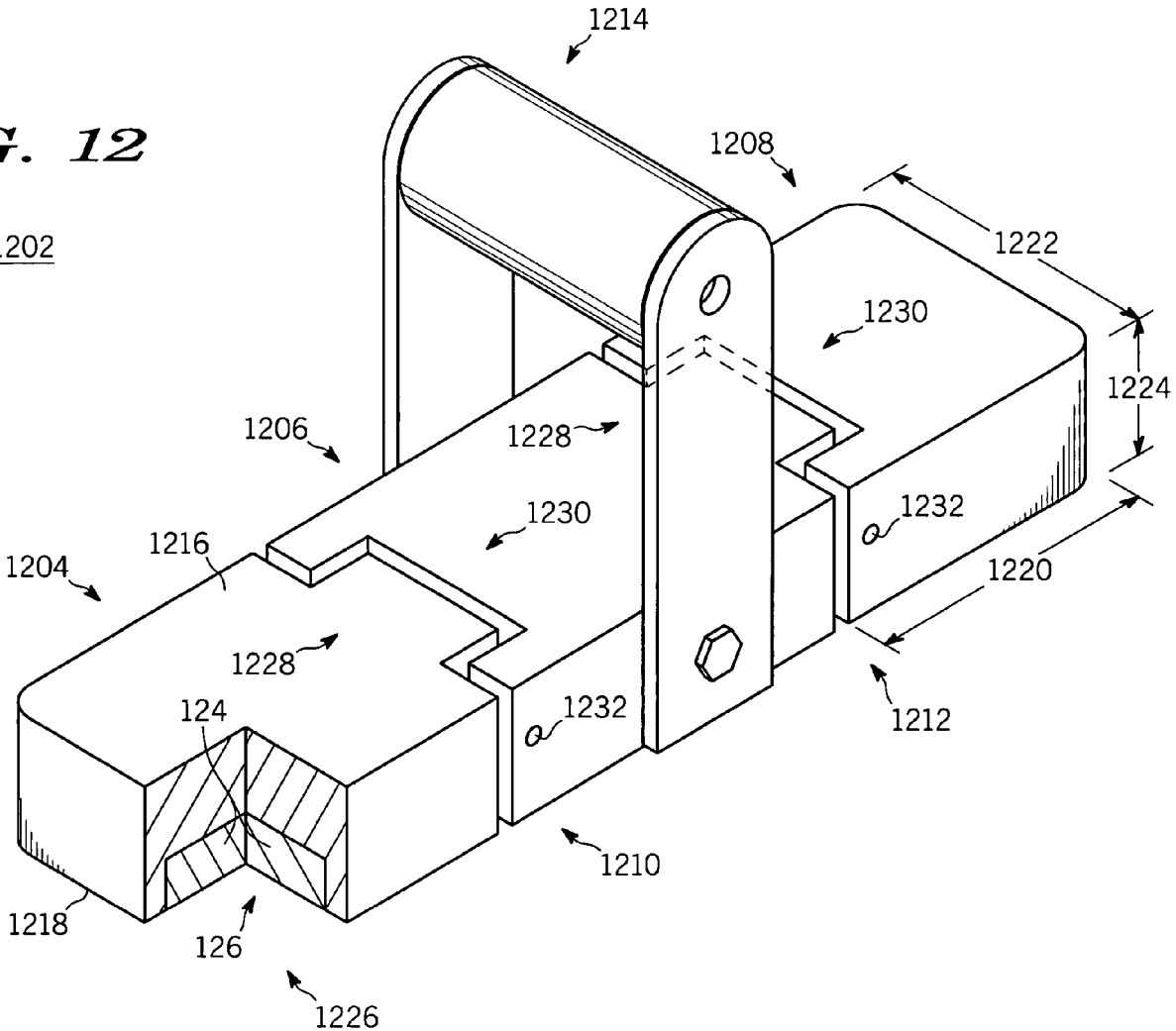
FIG. 12 is a greatly simplified cut-away perspective view of a flexible affixing device.

FIG. 12 is a greatly simplified cut-away perspective illustrated view of a flexible affixing device 1202. Flexible affixing device 1202 includes several elements such as sections 1204, 1206, and 1208, a handle 1214 and hinging devices 1210 and 1212. Handle 1214 may be provided depending upon the specific application and use. Additionally, handle 1214 can be made as previously described. For example, when flexible affixing device 1202 is strongly attracted to a work piece, handle 1214 can be used either to carry the work piece or to remove the work piece from flexible affixing device 1202. While flexible affixing device 1202 is shown having sections 1204, 1206, and 1208, it should be understood that flexible affixing device 1202 can have as few as two sections or can be extended to include any suitable number of sections. Sections 1204, 1206, and 1208 have surfaces 1216 and 1218, wherein surface 1216 forms a top surface and 1218 forms a bottom surface.

Sections 1204, 1206, and 1208 can be made from any suitable magnetic or nonmagnetic material depending upon the specific application. For example, magnetic materials such as, but not limited to, cold rolled steel, hot rolled steel, cast steel combinations thereof, or the like can be used. Alternatively, example of non-magnetic materials such as, but not limited to aluminum, tungsten, some stainless steels, plastics, combinations thereof, or the like can also be used. It should be understood that the selection of materials used for sections 1204, 1206, and 1208 is application specific and can encompass a wide range of materials and alloys not specifically mentioned herein above.

Sections 1204, 1206, and 1208 can be made any one of a number of different manufacturing technologies such as, but not limited to, milling, molding, or the like. Also, sections 1204, 1206, and 1208 can be configured to any suitable shape or foot print such as, but not limited to, rectangular, circular, oval, triangular, or the like. It should be understood that by changing shapes of sections 1204, 1206, and 1208 into different shapes, sections 1204, 1206, and 1208 will be able to fit into a wide variety of places and applications.

Individual sections 1204, 1206, and 1208 can be made to any suitable dimensional size and can vary widely depending upon the specific application. For example, in some instances, length 1220 can range from 2.0 centimeters to 30.0 centimeters. Width 1222 can be any suitable size and can vary widely depending upon the specific application. For example, in some instances, width 118 can range from 2.0 centimeters to 30.0 centimeters. Thickness 1224 can be made to any suitable size and can vary in accordance with the specific application. For example, in some instances, thickness 1224 can range from 5.0 millimeters to 5.0 centimeters depending upon the specific application.

As shown in FIG. 12, a cut away portion 1226 exposes magnetic device 124 with groove or recess 126. Magnetic device 124 and groove 126 have been previously described and will not be described in detail here except to provide more clarity.

Hinging device 1212 connects sections 1204, 1206, and 1208 together so that sections 1204, 1206, and 128 are flexible. It should be understood that any suitable flexible device could be used such as, but not limited to, a hinging device, a swiveling device, rotating device, or the like.

As shown in FIG. 12, hinging device 1212 is formed so that sections 1204, 1206, and 1208 are inter-digitized by tongue portions 1228 and groove portions 1230. The inter-digitized portions 1228 and 1230 are flexibly connected with pins 1232.

Thus, flexible affixing device 1202 provides the ability to adhere to curved surfaces. Moreover, these curved surfaces can be manipulated and held in new positions so that work can be done on the work piece.

EXAMPLES

For all of the examples, base 104 was made of cold rolled steel with groove 126 being milled from base 104. Base 104 was six inches long having a width of 1.5 inches. Various different magnetic devices 124 where disposed into groove 126 of base 104 to perform several tests. Several pieces of flat cold rolled steel with different thicknesses (⅛, 3/16, and ¼ inch) were used to perform separation tests. The separation tests where in the form of placing one of the pieces of flat cold rolled steel in contact with the base. The force was then measure to determine the amount of force required to separate the piece of cold rolled steel from the base 104. The magnetic attraction or force was measured in pounds with the maximum pounds being noted prior to separation or the piece of cold rolled steel (not shown) from base 104.

Figure 13:
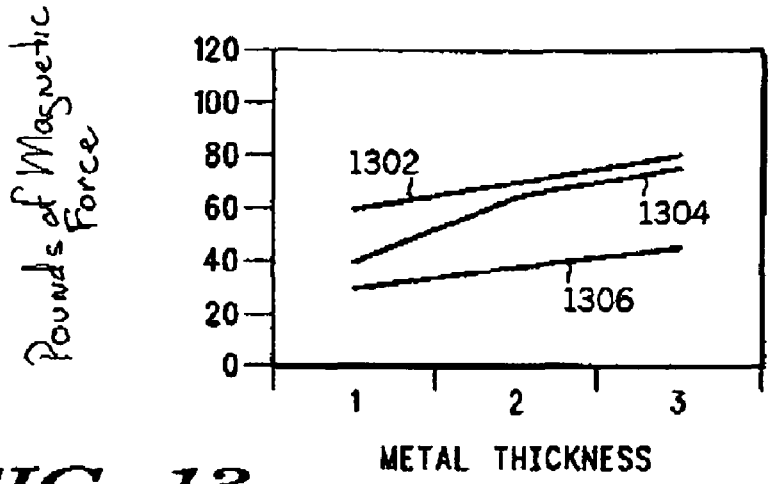
FIGS. 13-15 are simplified illustrated graphs showing various physical relationships and their effects on magnetic force.

In a first set of examples, groove 126 of base 104 was disposed sequentially with rare earth (specifically in this example, Neodymium) magnets having different surface areas (0.375, 0.785, 1.0 sq. in.). After the disposing of the rare earth magnets into groove 126, separation tests where performed on the various set ups. FIG. 13 illustrates results from the various separation tests. Lines 1302, 1304, and 1306 represent results taken that correspond to the rare earth magnets having surface areas of 0.375, 0.785, and 1.0 sq. inches, respectively. As shown in FIG. 13, as the thickness of the cold rolled steel increases, the force required to separate the cold rolled steel from base 104 increases. Additionally, as the surface area of the rare earth magnet(s) increased, the force required for separation increased.

Figure 14:
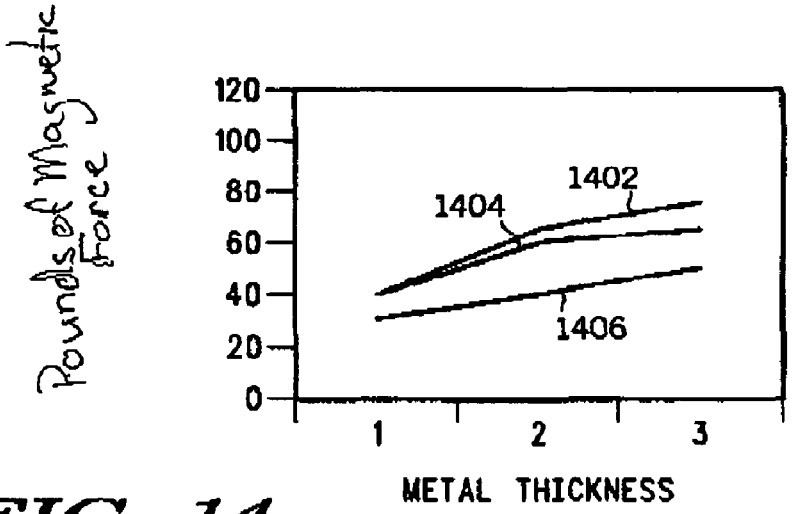
Figure 15:
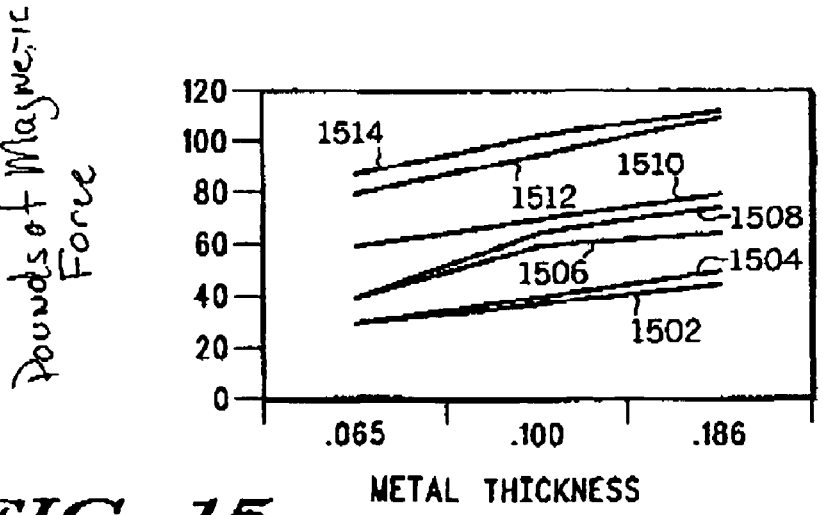

In a second set of examples, separation tests were run with thicknesses (0.96, 0.137, and 0.25 inch) of the rare earth magnets being varied. As shown in FIG. 14, lines 1402, 1404, and 1406 show results taken correspond to the thickness of the rare earth magnets, respectively. As can be seen, as the thickness of the rare earth magnets increased, the force required to achieve separation increases.

In a third set of examples, various configurations of rare earth magnets are tested by the separation method identified previously. Line 1502 represents test results from magnets shaped as a rectangle being ½×¼ inches and having a thickness of ¼ inch. Line 1504 represents test results from magnets shaped as a 1.0 inch circle with a thickness of 0.096 inch. Line 1506 represents test results from magnets shaped as a 1.0 inch circle with a thickness of 0.137 inch. Line 1508 represents test results from magnets shaped as a 1.0 inch circle with a thickness of 0.25 inch. Line 1510 represents test results from magnets shaped as a 1.0 inch square with a thickness of 0.25 inch. Line 1512 represents test results from magnets shaped as a 1.0 inch square with a thickness of 0.5 inch. Line 1514 represents test results from magnets that are ½ inch square that are assembled into a one inch square.

In the foregoing specification, the invention has been described with reference to specific embodiments. However, one of ordinary skill in the art appreciates that various modifications and changes can be made without departing from the scope of the invention as set fourth in the claims below. Accordingly, the specification and figures are to be regarded in an illustrative rather then a restrictive sense and all such modification are intended to be included within the scope of the invention. Benefits, another advantages, and solution to problem have been described above with regard to specific embodiments. However, the benefits, advantages, solutions to problems, and any element(s) that may cause any benefit, advantage, or solution to occur or become more pronounced are not to be construed as a critical, required or essential feature or element of any or all of the claims.

I claim:

1. A temporary affixing device for temporarily holding a construction element comprising:

a base portion having a first surface with a groove disposed into the first surface and a second surface;

a magnetic device having a third and fourth surface, the magnetic device disposed into the groove and wherein the magnetic device having a magnetic force of at least twenty pounds;

an adhesive material permanently affixing the first surface of the base portion to the third surface of the magnetic device;

a securing device system attached substantially to the center second surface of the base portion for connecting a cable; and a holding handle having at least one arm with at least one end portion fixedly connected to the base, the at least one end portion of the at least one arm rotatably mounted to the base portion.

2. The temporary affixing device as claimed as claim 1 wherein, the magnetic device includes a rare earth magnetic material.

3. The temporary affixing device as claimed in claim 1 wherein, the magnetic device includes a ceramic magnetic material.

4. The temporary affixing device as claimed in claim 1 wherein, the magnetic device includes a ferrite magnetic material.

5. The temporary affixing device as claimed in claim 1 wherein, the base portion includes a ferrous material.

6. The temporary affixing device as claimed in claim 5 wherein, the ferrous material is a steel composition.

7. The temporary affixing device as claimed in claim 1 wherein, the base portion includes a non-ferrous material.

8. The temporary affixing device as claimed in claim 1 wherein, the handle is made of a non-ferrous material.

9. The temporary affixing device as claimed in claim 8 wherein, the handle includes ferrous material.

10. The temporary affixing device as claimed in claim 1 wherein, the handle includes a plastic material.

11. The temporary affixing device as claimed as in claim 1 wherein, the handle includes organic material.

12. The temporary affixing device as claimed as claim 1 wherein, the fourth surface of the magnetic device is at least flush with the first surface of the base portion.

13. A temporary affixing device for temporarily holding a construction element comprising:

a base portion having a first surface, a second surface, and a groove having a depth, a length, a width, and an upper surface disposed into the first surface of the base portion;

a magnetic device having a third and fourth surface, the magnetic device disposed into the groove, wherein the fourth surface of the magnetic device is at least flush with the first surface of the base portion;

an adhesive material permanently affixing the first surface of the base portion to the third surface of the magnetic device;

a securing device system attached substantially to the center second surface of the base portion for connecting to a cable; and a holding handle having at least one arm with at least one end portion fixedly connected to the base, the at least one end portion of the at least one arm rotatably mounted to the base portion.

14. A temporary affixing device for temporarily holding a construction element as claimed in claim 13 further comprising:

a protective shield disposed over the magnetic device.

* * * * *